US005917164A

United States Patent [19]

Sasaki

[11] Patent Number: 5,917,164

[45] Date of Patent: Jun. 29, 1999

[54] PRESSURE-SENSITIVE SWITCH WITH POLYPHENYLENE SULFIDE RESIN RECEIVING MEMBER

[75] Inventor: Keiji Sasaki, Tokyo, Japan

[73] Assignee: Fujikoki Corporation, Tokyo, Japan

[21] Appl. No.: 08/740,894

[22] Filed: Nov. 4, 1996

[51] Int. Cl.[6] ..... H01H 35/34

[52] U.S. Cl. ..... 200/83 P; 200/83 J; 200/302.1

[58] Field of Search ..... 91/1; 92/5 R, 101, 92/103 M; 307/118; 337/117, 320; 340/611, 626; 73/717, 723, 745, 861.47; 200/81.4, 81.5, 302.1, 83 R, 83 P, 83 J, 83 W, 83 N

[56] References Cited

U.S. PATENT DOCUMENTS 4,827,094 5/1989 Tanaka ..... 200/83 P
4,939,321 7/1990 Tanaka ..... 200/83 P
5,461,208 10/1995 McKenna ..... 200/83 J

FOREIGN PATENT DOCUMENTS 7-101583 11/1995 Japan .
7-114094 12/1995 Japan .

*Primary Examiner*—Gerald Tolin
*Attorney, Agent, or Firm*—Foley & Lardner

[57] ABSTRACT

A pressure-sensitive switch typically used in an automobile engine room comprises: a housing having a passage communicating with a pressurized fluid path; a switch case fixed to the housing; a diaphragm contained in an interior space defined by the housing and the switch case; a snap disk 31 responsive to an applied pressure to change its shape between two aspects by a snapping motion; a receiving member 50 that receives the snap disk, and switch elements closed or opened by the snapping motion of the snap disk. The receiving member 50 is made of polyphenylene sulfide (PPS) resin.

3 Claims, 5 Drawing Sheets

FIG. 2

COMPARISON OF IMPORTANT CHARACTERISTICS OF RECEIVING MATERIALS

| item | | PBT resin | PPS resin |
|---|---|---|---|
| pulling strength | MPa | 132.4 | 1.57 |
| elongation in tension | % | 4 | 1.3 |
| flexural modulus | GPa | 7.85 | 13.7 |
| hardness | M scale | 94 | 106 |
| deflection temperature under load | °C ($18.6 kgf/cm^2$) | 215 | 260 or more |
| mold shrinkage factor | % | 0.2~0.7 | 0.2~0.7 |
| coefficient of linear expansion | $10^{-5}$/K | 3 | 2.2 |
| absorption coefficient | % | 0.07 | 0.02 |
| specific insulation resistance | Ω:cm | $10^{16}$ | $10^{16}$ |

FIG. 4

CHANGES IN CHARACTERISTICS (μm)

| | | | Embod. 1 PPS resin ceramic | Embod. 2 PPS resin phenolic resin | Prior Art PBT resin phenolic resin |
|---|---|---|---|---|---|
| high-pressure resistance test | first operative point | 10,000 | -25 ~ +15 | -35 ~ +15 | -65 ~ -35 |
| | | 30,000 | -40 ~ -20 | -45 ~ 0 | -100 ~ -70 |
| | second operative point | 10,000 | -25 ~ +20 | -15 ~ +25 | -35 ~ -5 |
| | | 30,000 | -15 ~ +20 | -15 ~ +25 | -20 ~ -5 |
| | ON/OFF position | 10,000 | -40 ~ 0 | -15 ~ +25 | -30 ~ +20 |
| | | 30,000 | - - - | - - - | - - - |
| | deformation at the contact to snap disk | 10,000 | small def. | small def. | large def. |
| | | 30,000 | small def. | small def. | large def. |
| high-temp. high-pressure shelf test | first operative point | 144 hrs | -45 ~ -15 | -45 ~ 0 | -115 ~ -80 |
| | | 270 hrs | -40 ~ -5 | -40 ~ -5 | -120 ~ -95 |
| | second operative point | 144 hrs | -45 ~ 0 | -45 ~ 0 | -50 ~ -20 |
| | | 270 hrs | -30 ~ +15 | -30 ~ +15 | -40 ~ -15 |
| | ON/OFF position | 144 hrs | +10 ~ +30 | +10 ~ +30 | -20 ~ 0 |
| | | 270 hrs | - - - | - - - | - - - |

PRESSURE-SENSITIVE SWITCH WITH POLYPHENYLENE SULFIDE RESIN RECEIVING MEMBER

BACKGROUND OF THE INVENTION

1. Field of the Invention

This invention relates to a mechanism of a pressure-sensitive switch typically used in an automobile refrigerating system to protect the system by inactivating its compressor when the refrigerant pressure in the refrigerating cycle decreases or increases beyond a predetermined value.

2. Description of the Prior Art

The Applicant proposed pressure-sensitive switches disclosed in Japanese Patent Publication Nos. 7-101583(1995) and 7-114094(1995).

A mechanism of a pressure-sensitive switch of this type is explained below with reference to the cross-sectional view shown in FIG. 1. The pressure-sensitive switch is generally composed of a housing 10 which is symmetric about its own axis and defines a fluid passage 11 in its upper portion to permit a fluid to flow in and to transmit its pressure, a pressure-sensitive switching mechanism, and a switch case 20.

The switch case 20 is made of an electrically insulated material, such as polybutylene terephthalate resin reinforced by glass fiber. The switch case 20 defines an interior space containing the pressure-sensitive switching mechanism and opening at its upper end, and a lower opening for electrical connection. The interior space and the lower opening are partitioned by a partition wall 23.

The pressure switching mechanism is made up of a diaphragm 30 made of, for example, a polyimide resin film, first snap disc 31 made of steel, switch receiving member 50 made of polybutylene terephthalate (hereinafter called PBT), operating rod 54, first switch lever 41, second switch lever 42, and a pair of terminals 40.

The outer circumferential portion of the diaphragm 30 of the pressure-sensitive switching mechanism is airtightly secured between the switch case 20 and the housing 10 by a packing 25.

The switch receiving member 50 has a disc-like configuration, having a circular outer wall standing along the upper outer circumferential edge of the disc, a center hole 52, and a center projection 53 made by projecting the circumferential wall of the center hole downwardly from the lower surface of the disc.

The switch receiving member 50 is contained in the interior space of the switch case 20 for sliding movements in the vertical direction.

The inner wall of the interior space of the switch case 20 has a step portion 21 for limiting downward movement of the switch receiving member 50 beyond the step portion 21. Also made below the step portion 21 is a small-diameter step portion 22 supporting the outer circumferential edge of the second snap disc 32.

The first snap disk 31 is supported opposite to the diaphragm 30 by the outer wall 51 of the switch receiving member 50. The operating rod 54 extends through the center hole 52 of the switch receiving member 50 above the second switch lever 42 such that its upper end contacts the lower surface of the first snap disk 31.

The center projection 53 of the switch receiving member 50 engages with the center hole 32*a* of the second snap disk 30 having an upwardly convexed shape, and the bottom end of the center projection 53 confronts with the center of the upper surface of the first switch lever 41.

The first switch lever 41 has a contact 43 at its distal end, and the second switch lever 42 has a contact 44 at its distal end opposite to the contact 43 of the first switch to form a switch.

A pair of terminals 40 are connected to the first switch lever 41 and the second switch lever 42, respectively, and are introduced to the lower opening of the switch case 20, passing through the partition wall 23.

The pressure-sensitive switch having the above construction operates as explained below.

The pressure of a fluid introduced onto the diaphragm 30 through the fluid passage 11 depresses the diaphragm 30 downwardly, and the switch receiving member 50 supporting the first snap disk 31 is depressed downwardly. When the pressure reaches 250 kPa, for example, the second snap disk 32 deforms from a first aspect, that is upwardly convexed as shown in FIG. 1, to a second aspect that is downwardly convexed. That is, the switch receiving member 50 moves downwardly due to depression by the fluid pressure, and the center projection 53 depresses the first switch lever 41 to close the switch.

The downward movement of the switch receiving member 50 is limited by the step portion 21 on the inner wall of the switch case 20 even when the fluid pressure becomes higher. Therefore, the second snap disk 32 does not receive an excessive force that might make it inoperative due to an unacceptable deformation.

When the fluid pressure decreases to 210 kPa, the second snap disk 32 restores its first aspect from the second aspect, and the switch receiving member 50 moves upwardly, removing its depression from the first switch lever 41. Thus, the switch is opened.

When the fluid pressure further increases to 2.7 MPa after the switch receiving member 50 abuts the step portion 21 and makes the switch ON, the first snap disk 31 deforms from the upwardly convexed first aspect to the downwardly convexed second aspect, and transmits the displacement to the operating rod 54 and then to the second switch lever 42 to press is downwardly. Thus, the switch is opened.

In this manner, the proposed pressure-sensitive switch is turned ON by a pressure within a predetermined range, and is turned OFF by both high pressures and low pressures beyond the predetermined pressure range.

To use the switch in a refrigerating cycle of an automobile refrigerating system, it is typically mounted in an engine room that is held at high temperatures of or beyond 100° C.

As explained above, the conventional pressure-sensitive switch uses PBT resin as the material of the switch receiving member 50. By using the conventional pressure-sensitive switch in circumstances with the temperature held at 100° C. for a long time, the Inventor found the fact that a creep as shown in the broken-lined circle A in FIG. 5 is produced at the foot of the outer wall 51 of the switch receiving member 50 receiving the load of the first snap disk 31 and that the snap disk 31 bites into the surface of the switch receiving member 50.

Thus, the Inventor also found a high possibility that the biting of the outer edge of the snap disk 31 into the foot of the outer wall of the switch receiving member 50 disturbs intended behaviors of the pressure-sensitive switch.

SUMMARY OF THE INVENTION

It is therefore an object of the invention to provide a pressure-sensitive switch reliably operative without causing a creep in its switch receiving member even when used in an automobile engine room for a long time.

In order to attain the object, a switch receiving member used in a pressure-sensitive switch of the present invention to support a snap disk is made of a material that does not cause a creep even by a long-time use under a circumstance with a high temperature and with repeated application of a shear force.

A material, among others, chosen by the present invention as the material that does not cause a creep even by a long-time use under a circumstance with a high temperature and with repeated application of a shear force is polyphenylene sulfide (PPS) resin.

That is, according to the invention, there is provided a pressure-sensitive switch comprising: a housing having a passage communicating with a pressurized fluid passage; a switch case fixed to the housing; a diaphragm contained in an interior space defined by the housing and the switch case; a snap disk responsive to an applied pressure to change its configuration between two different aspects by a snapping motion; a switch receiving member receiving the snap disk; and switch elements closed and opened by the snap motion of the snap disk, wherein the switch receiving member is made of one of the group consisting of a PPS resin, PEEK resin and a polyether sulfone (PES) resin.

BRIEF DESCRIPTION OF THE DRAWINGS

FIG. 2 is a diagram explaining characteristics of a material used in the invention;

FIG. 4 is a diagram explaining effects of the invention; and

DETAILED DESCRIPTION OF THE PREFERRED EMBODIMENTS

Explained below is a specific embodiment of the pressure-sensitive switch according to the invention with reference to FIG. 1.

The pressure-sensitive switch according to the invention has the same structure as that of the conventional switch.

The conventional pressure-sensitive switch used the switch receiving member 50 made of PBT resin and the operating rod made of phenolic resin.

In contrast, in a first embodiment of the invention, the switch receiving member 50 is made of PPS resin, and the operating rod is made of ceramic.

In a second embodiment of the invention, the switch receiving member 50 is made of PPS resin, and the operating rod is made of phenolic resin.

As shown in FIG. 2, PPS resin used in the embodiment has better characteristics than those of PBT resin used for the conventional receiving member, namely, good heat resistance, high strength, high rigidity, less changes in physical properties at high temperatures.

That is, in pulling strength, elongation in tension, flexural modulus, hardness, deflection temperature under load, coefficient of linear expansion and absorption coefficient, PPS resin used in the embodiment is better than conventionally used PBT resin to make the switch receiving member. In mold shrinkage factor and specific insulation resistance, no difference is found between these materials.

Figure 3:
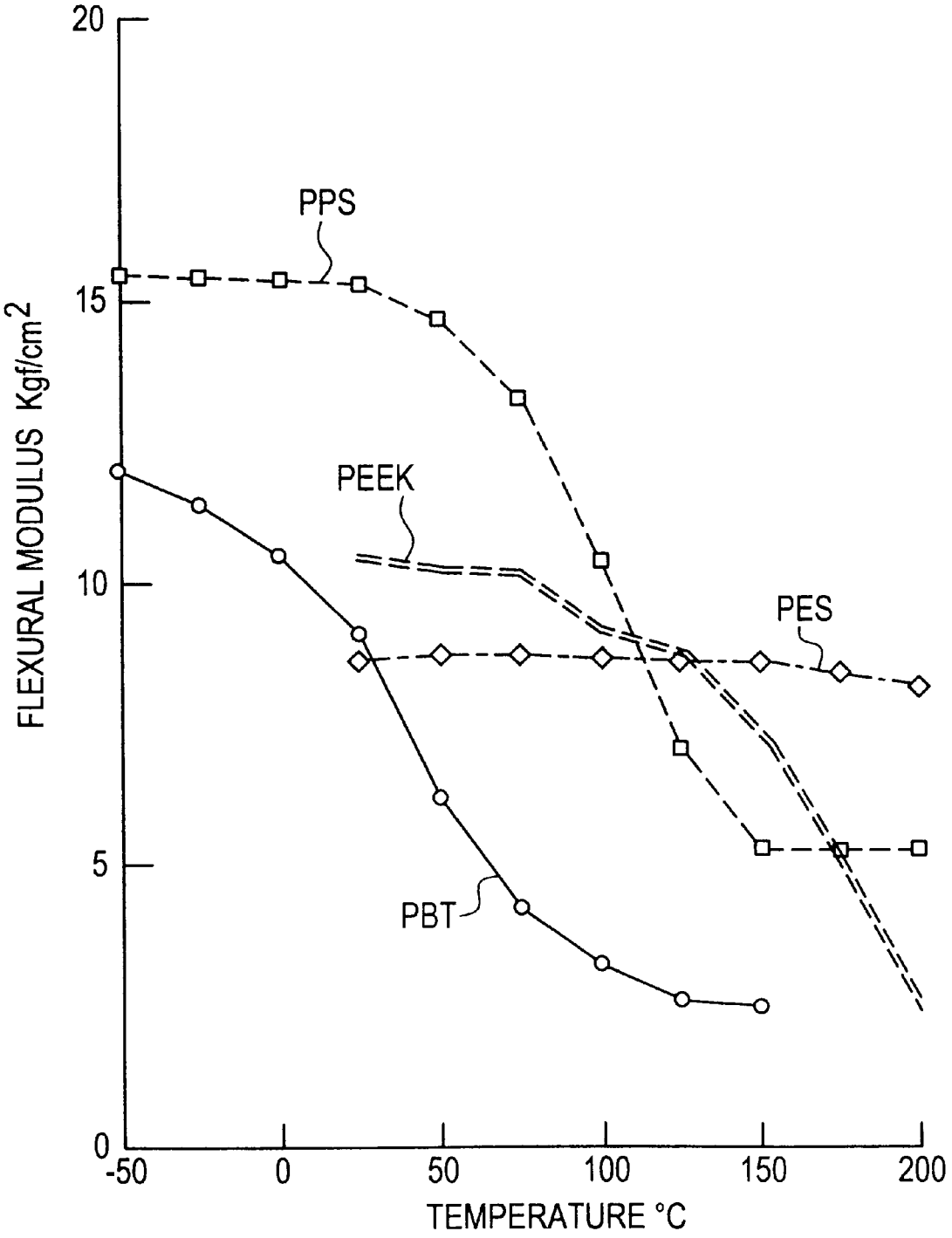
FIG. 3 is a characteristic diagram of a material used in the invention in terms of changes in flexural modulus with temperature.
Figure 5:
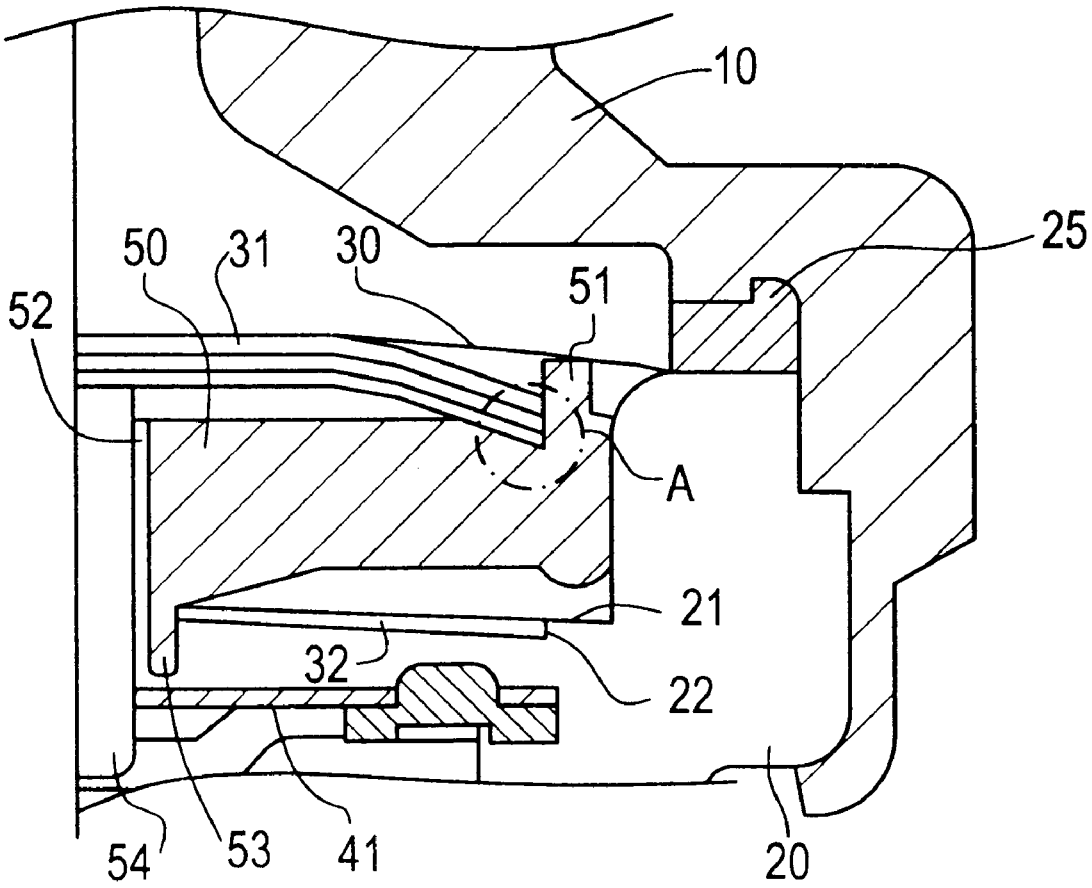
FIG. 5 is a fragmentary, enlarged, cross-sectional view of a portion of a conventional pressure-sensitive switch where a creep is produced.

It is also noted from FIG. 3 that PPS resin exhibits a higher value of flexural modulus even under increased temperatures than PBT resin, which means that PPS resin is more suitable for use at high temperatures.

That is, while the flexural modulus of PBT resin is about 3 kgf/cm$^2$ at 100° C., the flexural modulus of PPS is 10.5 kgs/cm$^2$ at 100° C.

Polyether ether ketone (PEEK) resin and polyether sulfone (PPS) resin also exhibit high values of flexural modulus at elevated temperatures as shown in FIG. 3. PEEK resin having a flexural modulus larger than 9 kgf/cm$^2$ at 100° C. and PES resin having the flexural modulus of approximately 8,5 kgf/cm$^2$ at 100° C. can minimize creeps like PPS resin.

Figure 1:
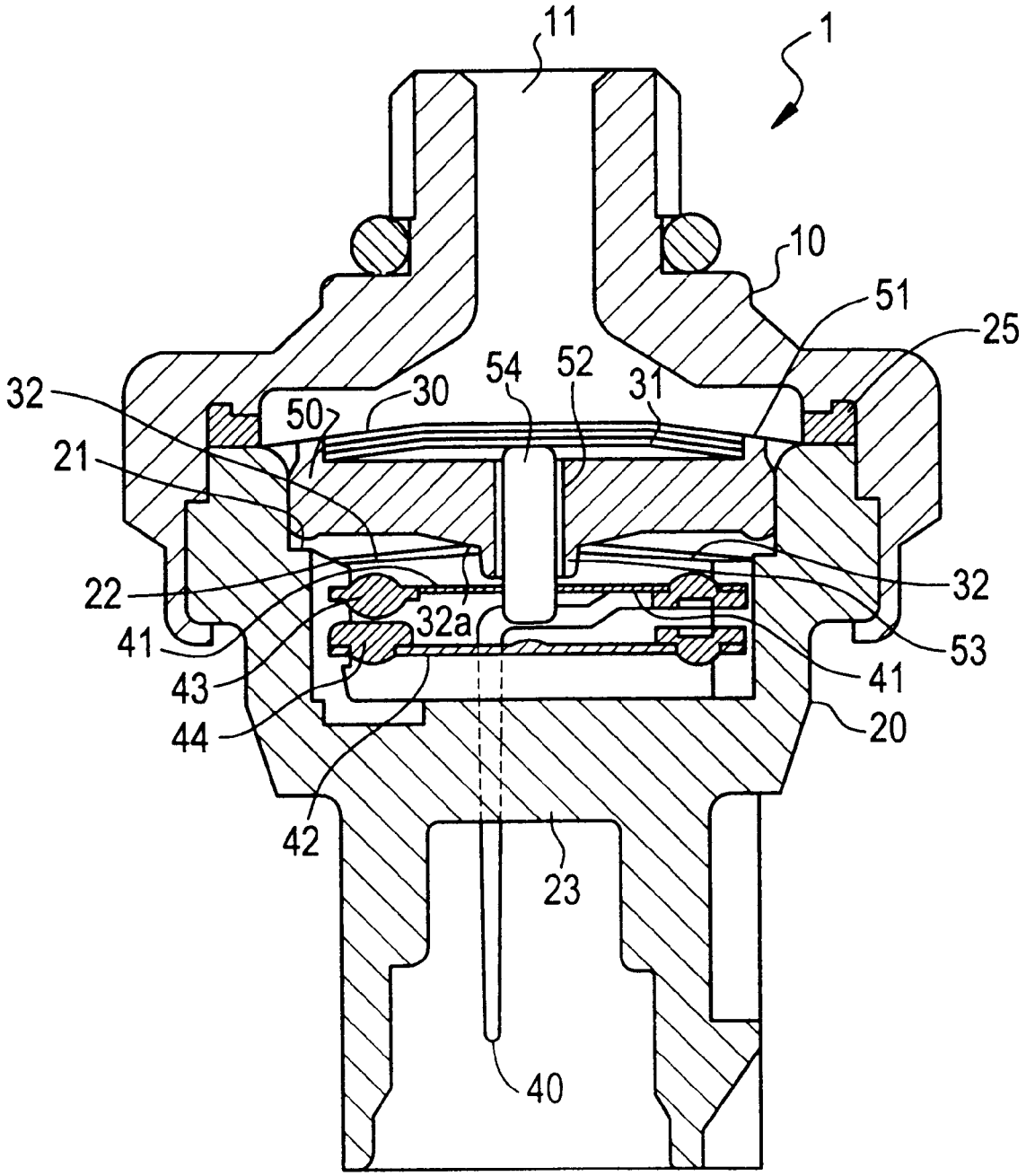
FIG. 1 is a cross-sectional view of a pressure-sensitive switch according to an embodiment of the invention.

There were prepared samples, namely, 20 sets for each of embodiments 1 through 4 using PPS resin, PEEK resin, and polyether sulfone (PES) resin as the receiving member of the pressure-sensitive switch having the construction of FIG. 1, and 20 sets of the conventional pressure-sensitive switch using PBT resin and using phenolic resin as the operating rod. Then, high-pressure resistance tests and high-temperature high-pressure shelf tests were made on every 10 sets.

High-pressure resistance tests were made by repeatedly applying the pressure of 10 kgf/cm$^2$G and 36 kgf/cm$^2$G at 100° C. After ten thousand times of the test, every five sets were disassembled, and remainder five sets were disassembled after thirty thousand times of the test. Then, changes in reverse lift amount, changes in return lift amount, changes in neck projecting amount, and physical changes of the portion of the receiving member in contact with the snap disk were observed.

High-temperature high-pressure shelf tests were made by leaving the samples under the pressure of 30 kgf/cm$^2$G at 100° C. The half five sets of each kind of samples were disassembled after 114 hours, and the remainder five sets after 270 hours. Then, changes in reverse lift amount, changes in return lift amount, changes in neck projecting amount, and physical changes at the portion of the receiving member in contact with the snap disk were observed.

Results of these tests are shown in FIG. 4.

In FIG. 4, the first operative point pertains to a position where the snap disk starts its snapping motion due to an increase in fluid pressure, the second operative point pertains to a position where the snap disk returns from the snap position due to a decrease in fluid pressure, and the ON/OFF position pertains to a position where the contacts are made ON or OFF due to the snapping motion. Changes in these factors are shown in $\mu$m.

As shown in FIG. 4, all pressure-sensitive switches according to the invention can decrease changes in operative point to ½ or less than those of the conventional pressure-sensitive switches, and can minimize the possibility that the snap disk bites into the receiving member and causes erroneous operations of the pressure-sensitive switch during practical use for a long time.

Although the embodiment described above has a two-point operative structure using two snap disks as the pressure-sensitive switching means, the invention is not limited to this, but may be applied to a three-point operative pressure-sensitive switch as disclosed in Japanese Patent Publication 7-114094(1995) or to a one-point operative pressure-sensitive switch using a single snap disk, only if the receiving member for receiving the snap disk is used.

As described above, the present invention can prevent a creep from being produced at the foot of an outer wall of a receiving member that receives a peripheral edge of a snap disk in a pressure-sensitive switch, and can therefore improve deterioration in functional characteristics of the pressure-sensitive switch.

The entire disclosure of Japanese Patent Application No. 8-107259 filed on Apr. 26, 1996, including the specifications, abstracts, drawings and claims, is incorporated herein by reference in its entirety.

What is claimed is:

1. A pressure-sensitive switch, comprising:

a housing having a passage communicating with a pressurized fluid path, a switch case fixed to said housing, a diaphragm contained in an interior space defined by said housing and said switch case, a snap disk responsive to an applied pressure to change its shape between two different aspects, a receiving member, different from said housing, receiving said snap disk, and switch elements operable in response to displacement of said snap disk, said pressure-sensitive switch being opened and closed according to the snapping motion of said snap disk and an operation of said switch elements, wherein said receiving member is made of a polyphenylene sulfide resin (PPS) material which reduces creep at a portion of the receiving member to which a load is applied by said snap disk, even with shear forces repeatedly applied thereto.

2. The pressure-sensitive switch as defined in claim 1, wherein said switch elements include an operating rod made of a ceramic material.

3. The pressure-sensitive switch as defined in claim 1, said switch elements include an operating rod made of a phenol resin.

* * * * *